US009389538B2

(12) United States Patent
Nakajima

(10) Patent No.: US 9,389,538 B2
(45) Date of Patent: Jul. 12, 2016

(54) IMAGE FORMING APPARATUS HAVING TONER SUPPLY CONTROL

(71) Applicant: CANON KABUSHIKI KAISHA, Tokyo (JP)

(72) Inventor: Takao Nakajima, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 17 days.

(21) Appl. No.: 14/309,138

(22) Filed: Jun. 19, 2014

(65) Prior Publication Data

US 2015/0010334 A1 Jan. 8, 2015

(30) Foreign Application Priority Data

Jul. 4, 2013 (JP) ..... 2013-140343

(51) Int. Cl.
*G03G 15/00* (2006.01)
*G03G 15/08* (2006.01)

(52) U.S. Cl.
CPC ..... *G03G 15/0877* (2013.01); *G03G 15/087* (2013.01); *G03G 15/0879* (2013.01); *G03G 2215/0678* (2013.01)

(58) Field of Classification Search
CPC ..... G03G 15/1615; G03G 21/1857–21/1864; G03G 2221/1654; G03G 2221/1657
USPC ..... 399/167
See application file for complete search history.

(56) References Cited

U.S. PATENT DOCUMENTS 6,122,458 A 9/2000 Kita et al.
7,412,192 B2 8/2008 Nakajima et al.
7,764,909 B2 7/2010 Nakajima et al.

(Continued)

FOREIGN PATENT DOCUMENTS

AU 2010232164 A1 11/2011
AU 2010232164 B2 5/2014

(Continued)

OTHER PUBLICATIONS

Great Britain Combined Search and Examination Report dated Dec. 24, 2014, in related Great Britain Patent Application No. 1411831.9.

(Continued)

*Primary Examiner* — Clayton E Laballe
*Assistant Examiner* — Trevor J Bervik
(74) *Attorney, Agent, or Firm* — Fitzpatrick, Cella, Harper & Scinto

(57) ABSTRACT

A toner supply system including a toner receiving apparatus and a toner supply container detachably mountable to the toner receiving apparatus. The toner supply container includes a container body containing toner, a discharge port permitting discharging of the toner in the container body, and a feeding portion feeding the toner in the container body. The toner receiving apparatus includes a toner receiving portion receiving the toner from the toner supply container, a driving mechanism engageable with the container body to rotationally drive the container body, and a regulating mechanism movable between a regulating position where rotation of the container body, which is in a set position and engaged with the driving mechanism, is regulated, and a releasing position, where regulation of rotation of the container body, which is in a set position and engaged with the driving mechanism, is released.

11 Claims, 12 Drawing Sheets

(56) References Cited

U.S. PATENT DOCUMENTS

| | | | | |
|---|---|---|---|---|
| 7,773,919 | B2 | 8/2010 | Nakajima et al. | |
| 7,796,923 | B2 | 9/2010 | Nakajima et al. | |
| 7,933,536 | B2 | 4/2011 | Ogawa | |
| 7,957,679 | B2 | 6/2011 | Nakajima et al. | |
| 8,131,189 | B2 | 3/2012 | Nakajima et al. | |
| 8,565,649 | B2 | 10/2013 | Murakami et al. | |
| 8,649,711 | B2 | 2/2014 | Nakajima et al. | |
| 2007/0280743 | A1 | 12/2007 | Nakajima et al. | |
| 2008/0304861 | A1* | 12/2008 | Ogawa | 399/111 |
| 2008/0304870 | A1 | 12/2008 | Nakajima et al. | |
| 2008/0304871 | A1 | 12/2008 | Nakajima et al. | |
| 2008/0304872 | A1 | 12/2008 | Nakajima et al. | |
| 2009/0129813 | A1* | 5/2009 | Nagashima et al. | 399/119 |
| 2010/0278565 | A1 | 11/2010 | Nakajima et al. | |
| 2011/0123231 | A1* | 5/2011 | Ozawa | 399/258 |
| 2011/0194876 | A1 | 8/2011 | Nakajima et al. | |
| 2012/0014713 | A1 | 1/2012 | Murakami et al. | |
| 2012/0114393 | A1 | 5/2012 | Nakajima et al. | |
| 2014/0016967 | A1 | 1/2014 | Murakami et al. | |
| 2014/0119776 | A1 | 5/2014 | Nakajima et al. | |
| 2014/0169835 | A1 | 6/2014 | Nakajima | |
| 2014/0233986 | A1 | 8/2014 | Murakami et al. | |

FOREIGN PATENT DOCUMENTS

| | | | |
|---|---|---|---|
| CA | 2757329 | A1 | 10/2010 |
| CA | 2891273 | A1 | 10/2010 |
| CA | 2891991 | A1 | 10/2010 |
| EP | 1818729 | A1 | 8/2007 |
| EP | 2209050 | A2 | 7/2010 |
| EP | 2211238 | A2 | 7/2010 |
| EP | 2357534 | A2 | 8/2011 |
| EP | 2416222 | A1 | 2/2012 |
| EP | 2211238 | B1 | 3/2012 |
| EP | 1818729 | B1 | 10/2013 |
| EP | 2 416 222 | B1 | 3/2015 |
| EP | 2 908 180 | A1 | 8/2015 |
| JP | H01-142684 | A | 6/1989 |
| JP | 09-160363 | A | 6/1997 |
| JP | 2705935 | B2 | 1/1998 |
| JP | 3401697 | | 4/2003 |
| JP | 2007-079167 | A | 3/2007 |
| JP | 4546369 | B2 | 9/2010 |
| JP | 2010-256893 | A | 11/2010 |
| WO | 2010/114153 | A1 | 7/2010 |

OTHER PUBLICATIONS

Great Britain Office Action dated Jul. 30, 2015, in related Great Britan Patent Application No. 1411831.9.

* cited by examiner

IMAGE FORMING APPARATUS HAVING TONER SUPPLY CONTROL

BACKGROUND OF THE INVENTION

1. Field of the Invention

The present invention relates to an image forming apparatus that can hold and interact with a toner storage container.

2. Description of the Related Art

In the prior art, as shown in U.S. Patent Application Publication No. 2012/014713 A1, there is proposed a toner storage container which reciprocates a pump portion in association with rotational operation of the toner storage container and discharges toner from a discharge port.

However, a user sometimes carelessly rotates a bottle as the toner storage container with his/her hand in such a state that the bottle is set at a set position. A developing device is then replenished with toner from the bottle, and this causes variation of toner concentration in a development device. Particularly, in a case of a configuration of directly replenishing the development device from the bottle, the problem becomes significant.

SUMMARY OF THE INVENTION

Thus, it is desirable to prevent accidental inflow of toner into a development device by providing a locking mechanism in a toner storage container.

According to the present invention, an image forming apparatus configured to hold a toner storage container having a drive input gear, the image forming apparatus comprising: a drive transmission mechanism configured to transmit drive from a drive motor to the drive input gear of the toner storage container when the toner storage container is mounted to the image forming apparatus; and a rotation regulating member which can be moved between: (i) a regulating position in which the toner storage container is regulated to rotate when the toner storage container is at a mounted position on the image forming apparatus, and (ii) a release position in which the toner storage container is allowed to rotate when the toner storage container is at a mounted position on the image forming apparatus.

Further features of the present invention will become apparent from the following description of exemplary embodiments with reference to the attached drawings.

DESCRIPTION OF THE EMBODIMENTS

An image forming apparatus of the present embodiment will be described. In the present embodiment, a color printer using an electrophotographic system will be exemplified and described.

<Image Forming Apparatus>

Figure 1:
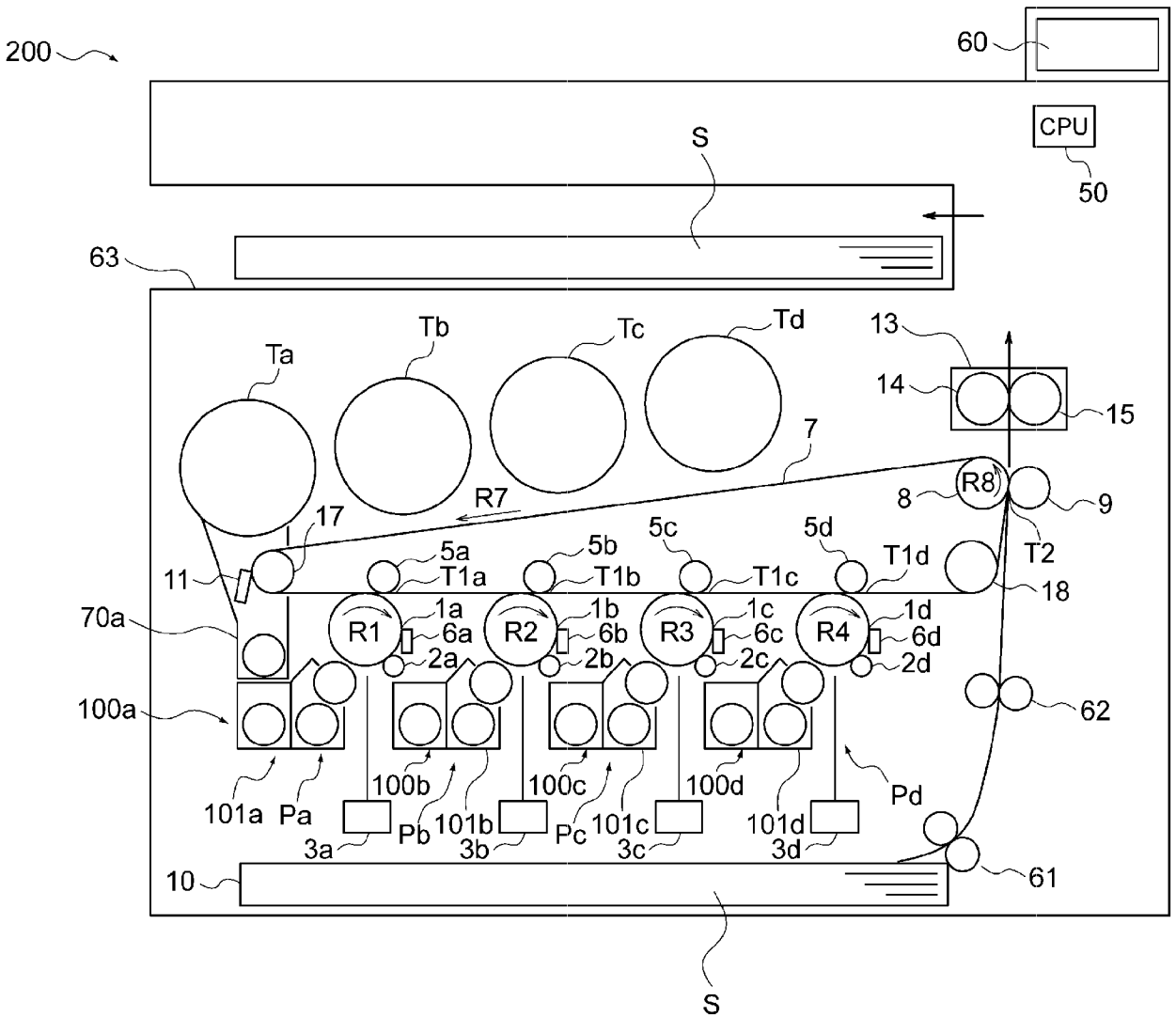
FIG. 1 is a cross-sectional view of an image forming apparatus.

FIG. 1 is a cross-sectional view of the image forming apparatus. In FIG. 1, a direction perpendicular to a sheet plane is a front depth direction of the apparatus. The image forming apparatus has a plurality of image forming portions which forms a toner image.

As illustrated in FIG. 1, an image forming apparatus 200 is a so-called intermediate transfer tandem image forming apparatus in which the image forming portions corresponding to four colors are arranged in a row on an intermediate transfer belt 7. The intermediate transfer tandem method has been recently mainly used because this method can correspond to high productivity and conveyance of various media.

<Process of Conveying Recording Material>

A recording material S is loaded and stored on a recording material storage 10. The recording material S is fed according to image formation timing by a feed roller 61 adopting a friction separation method. The recording material S fed out by the feed roller 61 passes through a conveyance path and is conveyed to a registration roller 62. After skew feeding correction and timing correction are performed in the registration roller 62, the recording material S is sent to a secondary transfer portion T2.

The secondary transfer portion T2 is a transfer nip portion including a secondary transfer inner roller 8 and a secondary transfer outer roller 9 facing each other. In the secondary transfer portion T2, when a predetermined pressurizing force and an electrostatic load bias are applied, a toner image is adsorbed onto the recording material S.

<Image Forming Process>

With respect to the above process of conveying the recording material S to the secondary transfer portion T2, a process of forming an image sent to the secondary transfer portion in similar timing will be described. The four image forming portions P (Pa, Pb, Pc, and Pd) are provided. Portions a, b, c, and d corresponding respectively to yellow (Y), magenta (M), cyan (C), and black (Bk) have a similar configuration, and therefore, the subscripts a to d are omitted as needed. However, the number of colors is not limited to four, and the arrangement order of the colors may not be the above order.

The image forming portion P has a photoreceptor 1 (1*a* to 1*d*). The image forming portion P further has a charging device 2 (2*a* to 2*d*), an exposure device 3 (3*a* to 3*d*), a developing device 100 (100*a* to 100*d*), a developing container 101 (101*a* to 101*d*), a primary transfer roller 5 (5*a* to 5*d*), and a photoreceptor cleaner 6 (6*a* to 6*d*) provided around the photoreceptor 1.

According to the above configuration, the image forming operation progresses in the following procedure. First, the photoreceptor 1 whose surface has been uniformly charged by the charging device 2 in advance is rotated and driven by a developing driving device (not illustrated). Next, the exposure device 3 irradiates with a laser based on a signal of image information sent to the image forming portion P. The laser with which the exposure device 3 has irradiated suitably passes through a diffraction unit and thereafter the photoreceptor 1 is exposed to the laser. Accordingly, an electrostatic latent image is formed on the photoreceptor 1.

The electrostatic latent image formed on the photoreceptor 1 is elicited as a toner image through toner development by the developing device 100. Subsequently, a predetermined pressurizing force and an electrostatic load bias are applied in a primary transfer portion T1 (T1a, T1b, T1c, and T1d) provided between the primary transfer roller 5 and the intermediate transfer belt 7. Accordingly, the toner image is transferred onto the intermediate transfer belt 7.

Meanwhile, transfer residual toner slightly remaining on the photoreceptor 1 without being transferred onto the intermediate transfer belt 7 from the photoreceptor 1 is recovered by the photoreceptor cleaner 6. Subsequently, the photoreceptor 1 prepares for the next image forming process to be performed again.

When the amount of toner in the developing device 100 is reduced, toner is supplied from a corresponding toner storage container T. At that time, a toner replenishing device 70 (70*a* to 70*d*, see FIG. 5) performs toner replenishing while synchronizing the driving with the corresponding developing device 100. The replenishing operation will be described later.

Figure 4:
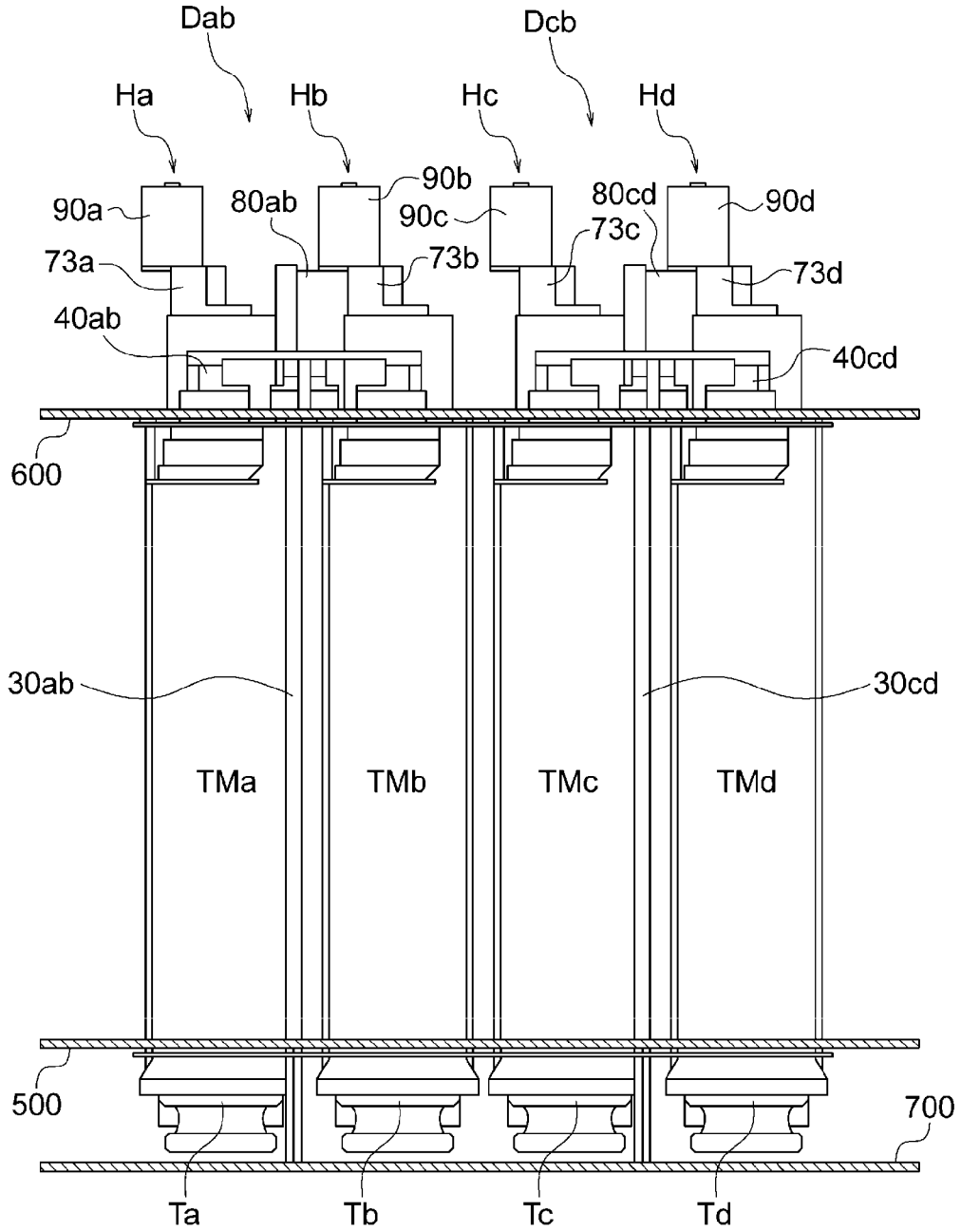
FIG. 4 is a top view of the image forming apparatus.

FIG. 4 is a top view of the image forming apparatus. As illustrated in FIG. 4, the toner storage container T (Ta to Td) is stored in and held by a toner storage container holding member TM (TMa to TMd) suspended between a front side plate 500 and a rear side plate 600 of the image forming apparatus. The toner storage container holding members TM are each independently suspended between the front side plate 500 and the rear side plate 600. In addition, the developing driving device is fastened with and installed at the rear side plate 600.

Although the developing container 101 stores a two-component developer in which nonmagnetic toner and a magnetic carrier have been mixed in advance, the developing container 101 may store a one-component developer containing only magnetic toner or the nonmagnetic toner. The present embodiment describes a case where the two-component developer (initial agent) is stored in the developing container 101.

Next, the intermediate transfer belt 7 will be described. The intermediate transfer belt 7 is an endless belt installed at an intermediate transfer belt frame (not illustrated). As illustrated in FIG. 1, the intermediate transfer belt 7 is stretched by the secondary transfer inner roller 8, a tension roller 17, and a secondary transfer upstream roller 18 serving as a drive transmission unit. The intermediate transfer belt 7 is driven to convey in a direction of an arrow R7 in the figure.

The image forming processes of the respective colors in the image forming portions P processed in parallel are performed at the timing when toner images of the respective colors are sequentially superposed on a toner image of upstream color primarily transferred on the intermediate transfer belt 7. As a result, eventually, a full color toner image is formed on the intermediate transfer belt 7 and is conveyed to the secondary transfer portion T2. Note that the transfer residual toner having passed through the secondary transfer portion T2 is recovered by the transfer cleaner 11.

(Process Following Secondary Transfer>

When the above conveyance process and the image forming process are performed, the recording material S and the full color toner image are matched in timing in the secondary transfer portion T2, and secondary transfer is performed. Subsequently, the recording material S is conveyed to a fixing device 13.

The fixing device 13 gives predetermined pressure and heat quantity to the passing recording material S in a fixing nip formed by rollers (a pressure roller 14 and a heating roller 15) facing each other to melt and fix a toner image on the recording material S. The heating roller 15 is provided with a heater as a heat source and is controlled always to maintain an optimum temperature.

The recording material S having the image thus fixed thereon is discharged onto a discharge tray 63. Alternatively, when double-sided image formation is required, the recording material S is conveyed to a sheet reversing and conveying apparatus (not illustrated).

<Toner Storage Container>

Figure 2A:
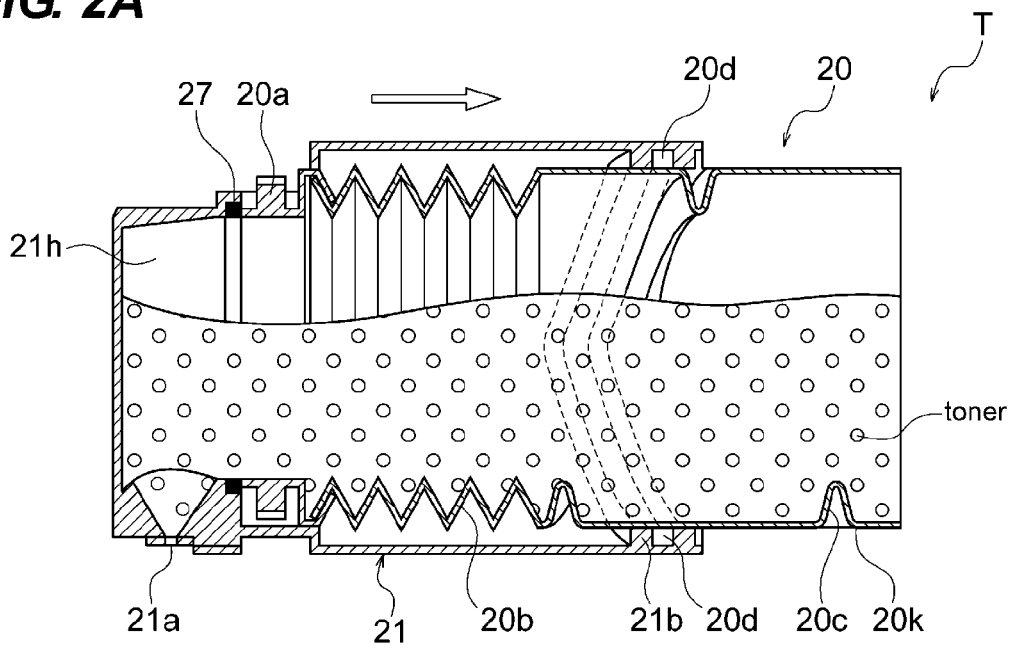
FIGS. 2A and 2B are cross-sectional views of a toner storage container.
Figure 2B:
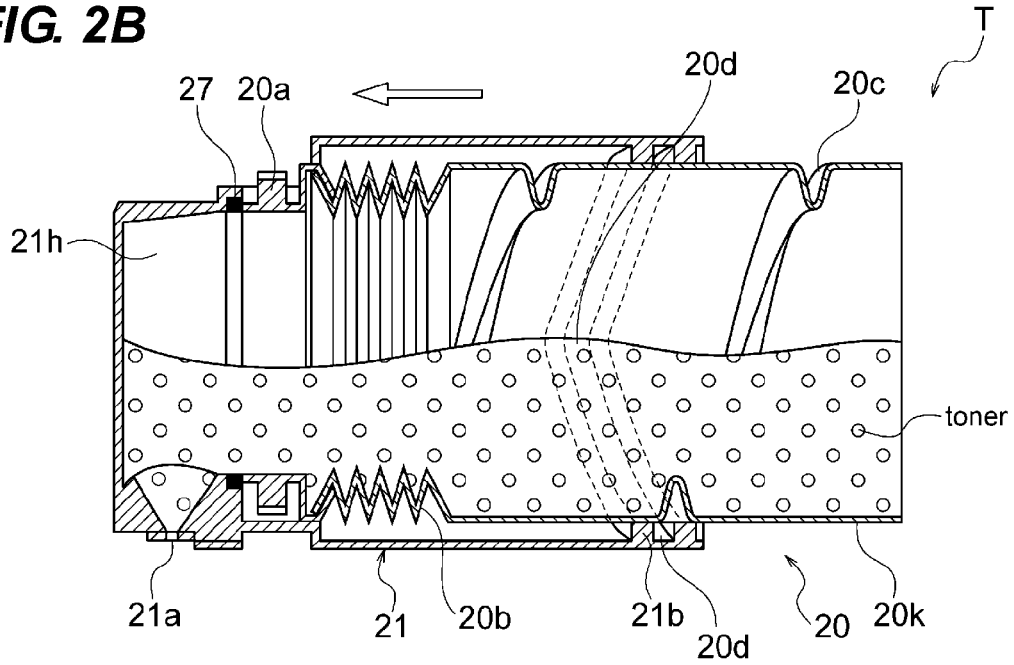

Next, the toner storage container T held by the toner storage container holding member TM will be described by using FIGS. 2A and 2B. FIGS. 2A and 2B are cross-sectional views of the toner storage container.

As illustrated in FIG. 2A, the toner storage container T is formed into a hollow cylindrical shape and has a toner storage portion 20 storing toner therein. The toner storage container T has a flange portion 21 (non-rotating portion) provided on one end side in the longitudinal direction (developer conveyance direction) of the toner storage portion 20. The toner storage portion 20 is configured to be relatively rotatable with respect to the flange portion 21.

The flange portion 21 is provided with a hollow discharge portion 21*h*, as illustrated in FIG. 2B. The discharge portion 21*h* temporarily retains toner conveyed from the inside of the toner storage portion 20. A small discharge port 21*a* is formed in a bottom portion of the discharge portion 21*h*. The discharge port 21*a* allows for discharge of toner to outside of the toner storage container T. Namely, the discharge port 21*a* replenishes the toner replenishing device 70 with toner.

A pump portion 20*b* of the present embodiment functions as an intake/exhaust mechanism which alternately performs intake operation and exhaust operation through the discharge port 21*a*.

As illustrated in FIG. 2B, the pump portion 20*b* is connected and fixed between the discharge portion 21*h* and a cylindrical portion 20*k*. Namely, the pump portion 20*b* can rotate integrally with the cylindrical portion 20*k*. In addition, the pump portion 20*b* of the present embodiment is configured to be capable of storing toner therein.

In the present embodiment, as the pump portion 20*b*, a resin-made variable volume type pump (bellows-like pump) having a volume variable in association with reciprocation is used. More specifically, as illustrated in FIGS. 2A and 2B, a bellows-like pump is used, and a plurality of "mountain folded" portions and a plurality of "valley folded" portions are alternately and periodically formed.

In addition, the pump portion 20*b*, as illustrated in FIG. 2B, has an end of the discharge portion 21*h* side provided on an inner surface of the flange portion 21. In addition, the pump portion 20*b* is fixed to be relatively rotatable with respect to the discharge portion 21*h* in a state of compressing a ring-shaped sealing member 27.

The toner storage container T is provided with a drive input gear 20*a*. The drive input gear 20*a* is fixed to one end side in the longitudinal direction of the pump portion 20*b*. Namely, the drive input gear 20*a*, the pump portion 20*b*, the cylindrical portion 20*k* are configured to be integrally rotatable. Accordingly, such a mechanism is adopted that a rotational driving force input to the drive input gear 20*a* is transmitted to the cylindrical portion 20*k* (and a conveying portion 20*c*) through the pump portion 20*b*.

Figure 3:
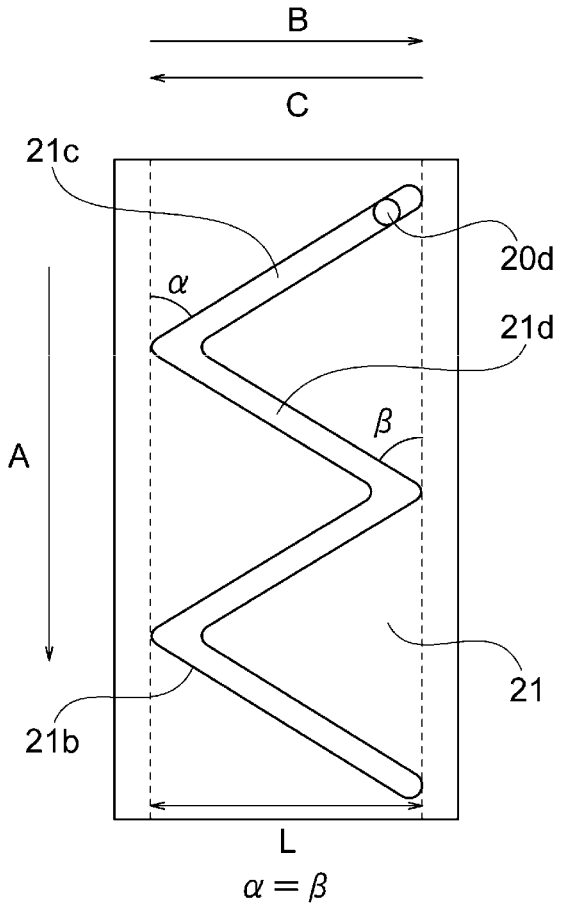
FIG. 3 is a partial enlarged view of the toner storage container.

Meanwhile, a cam groove 21*b* is formed over the whole circumference of an inner circumferential surface of the flange portion 21. The cam groove 21*b* functions as a driven portion into which a cam protrusion 20*d* is fitted. The cam groove 21*b* will be described by using FIG. 3. FIG. 3 is a partial enlarged view of the toner storage container.

In FIG. 3, an arrow A shows a rotational direction of the cylindrical portion 20*k* (a moving direction of the cam protrusion 20*d*), an arrow B shows an extension direction of the pump portion 20*b*, and an arrow C shows a compression direction of the pump portion 20*b*. In addition a cam groove 21*c* forms an angle α with respect to the rotational direction (arrow A) of the cylindrical portion 20*k*, and a cam groove 21*d* forms an angle β. In addition, an amplitude L (=extending and contracting length of the pump portion 20*b*) is in the extension and contraction direction (arrows B and C) of the pump portion 20*b* of the cam groove 21*b*.

More specifically, the cam groove 21*b*, as illustrated in FIG. 3 in which the cam groove 21*b* is developed, has a structure in which the cam groove 21*c* inclined from the cylindrical portion 20*k* side toward the discharge portion 21*h* side and the cam groove 21*d* inclined from the discharge portion 21*h* side toward the cylindrical portion 20*k* side are connected alternately. In the present embodiment, α=β is set.

Accordingly, the cam groove 21*b* of the flange portion 21 mating to the cam protrusion 20*d* of the toner storage portion 20 functions as a mechanism of drive transmission to the pump portion 20*b*. Namely, the cam protrusion 20*d* and the cam groove 21*b* convert the rotational driving force received by the drive input gear 20*a* into a force in a direction in which the pump portion 20*b* is moved reciprocally (a force in a rotational axis direction of the cylindrical portion 20*k*) and transmit the force to the pump portion 20*b*.

[Shutter Opening and Closing Mechanism]

Figure 11:
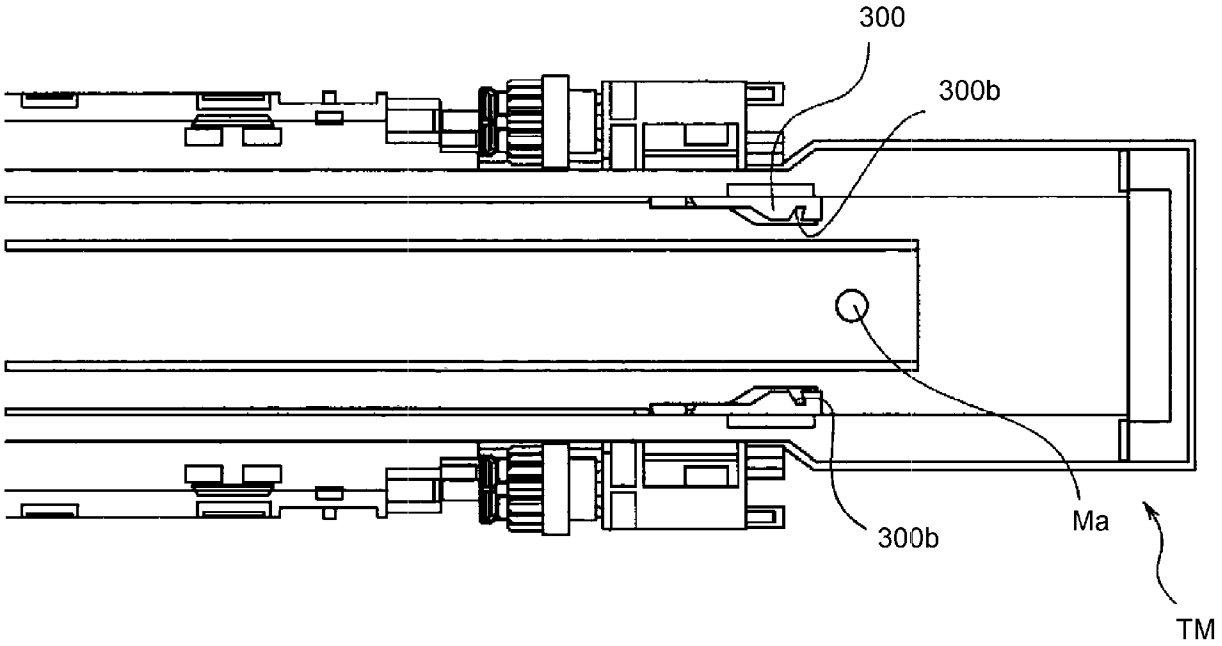
FIG. 11 is a top view illustrating a state in which the storage container and a driving device are removed.

FIG. 11 is a top view of the toner storage container holding member TM in such a state that a driving device is removed. The holding member TM has an opening Ma and is located at a position where the discharge port 21*a* of the toner storage container and the opening Ma of the holding member TM communicate with each other when the toner storage container T is mounted at a mounted position.

Figure 12A:
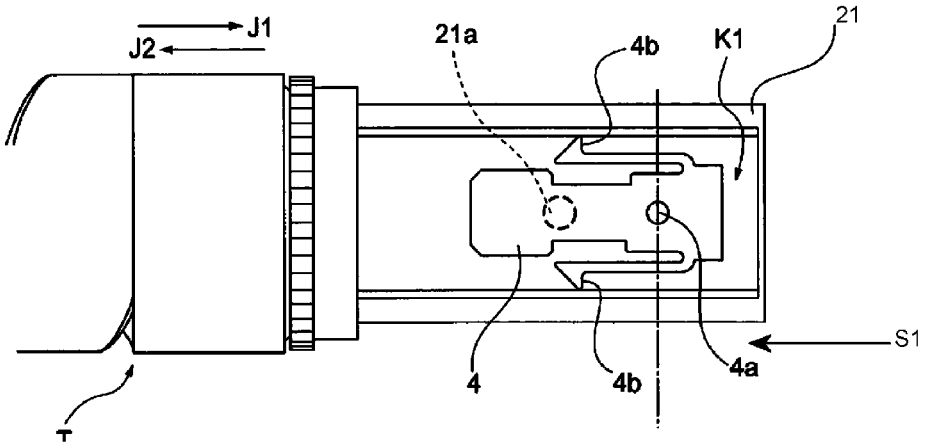
FIGS. 12A and 12B are rear views of the storage container.
Figure 12B:
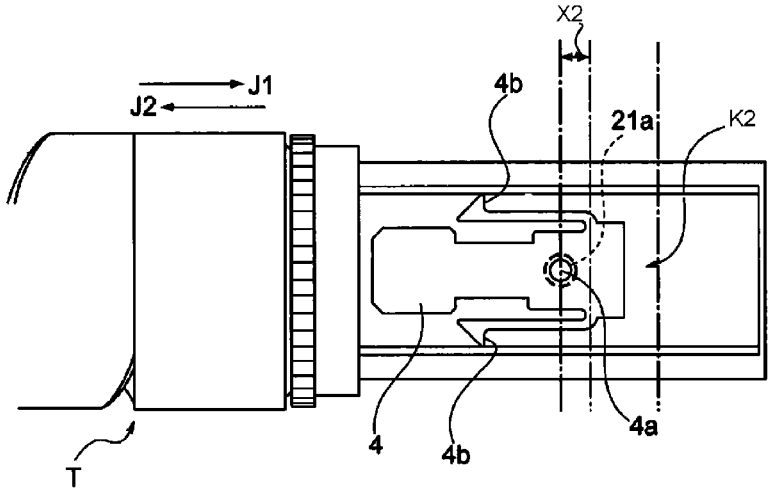

FIGS. 12A and 12B are rear views of the toner storage container T. As illustrated in FIG. 12A, the flange portion 21 is provided with a shutter 4 that opens and closes the discharge port 21*a* in a manner slidable into the toner storage container T. The shutter 4 seals the toner discharge port 21*a* formed in the toner storage container T. In the configuration of the present example, the shutter 4 can be opened and closed in conjunction with attachment/detachment operation (sliding operation) of the toner storage container T to/from a main body. Accordingly, toner storage containers T can be mounted to and unmounted from the image forming apparatus. Hereinafter, a specific configuration will be described.

As illustrated in FIG. 12A, a positional relationship between "a communication port 4*a* formed in the shutter 4 of the toner storage container T" and "the discharge port 21*a* formed in the flange portion 21 of the toner storage container T" is set so as to prevent overlap between the communication port 4*a* and the discharge port 21*a* in an uninstallation state in which the toner storage container T is not installed in an apparatus body. Accordingly, the shutter 4 seals the discharge port 21*a* so as to prevent toner in the toner storage container T from leaking to the outside. At this time, the shutter 4 is located at a first position K1 before the toner storage container T is inserted into the apparatus body of the image forming apparatus 200.

While the toner storage container T is being inserted into the apparatus body, the shutter 4 reaches a set position in the back of the apparatus body within the toner storage container T at the time when the toner storage container T is inserted at a certain position. In FIGS. 12A and 12B, an arrow J1 direction is an insertion direction, and an arrow J2 direction is a separating direction. At this position, a locking portion 4*b* of the shutter 4 of the toner storage container T engages with a locking portion 300*b* of a locking member 300 fixed to the toner storage container holding member TM.

When the toner storage container T is further being inserted into the apparatus body, the locking portion 4*b* of the shutter 4 slides by a predetermined amount in an arrow S1 direction with respect to the flange portion 21, and the communication port 4*a* of the shutter 4 and the discharge port 21*a* formed in the flange portion 21 of the toner storage container T communicate with each other, and toner can be discharged. At this time, the shutter 4 is located at a second position K2.

<Replenishing Configuration>

Figure 5:
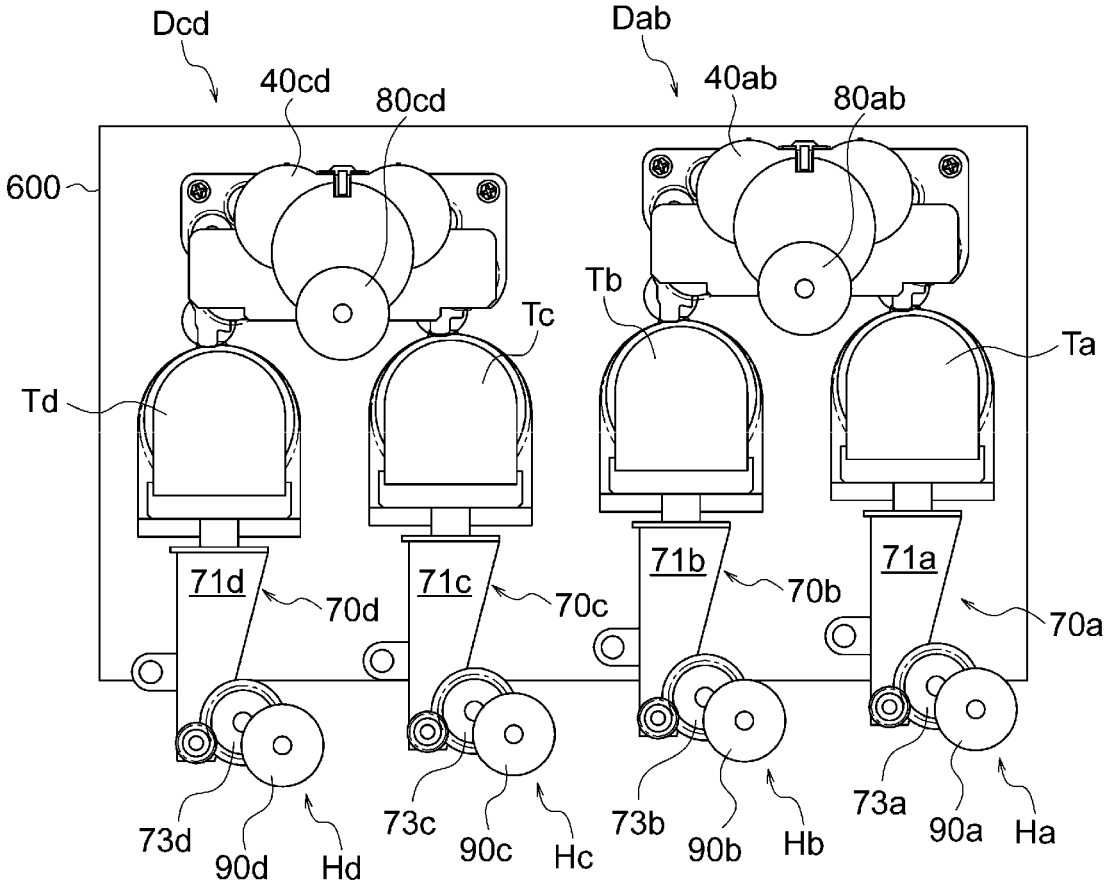
FIG. 5 is a rear view of the image forming apparatus.
Figure 6:
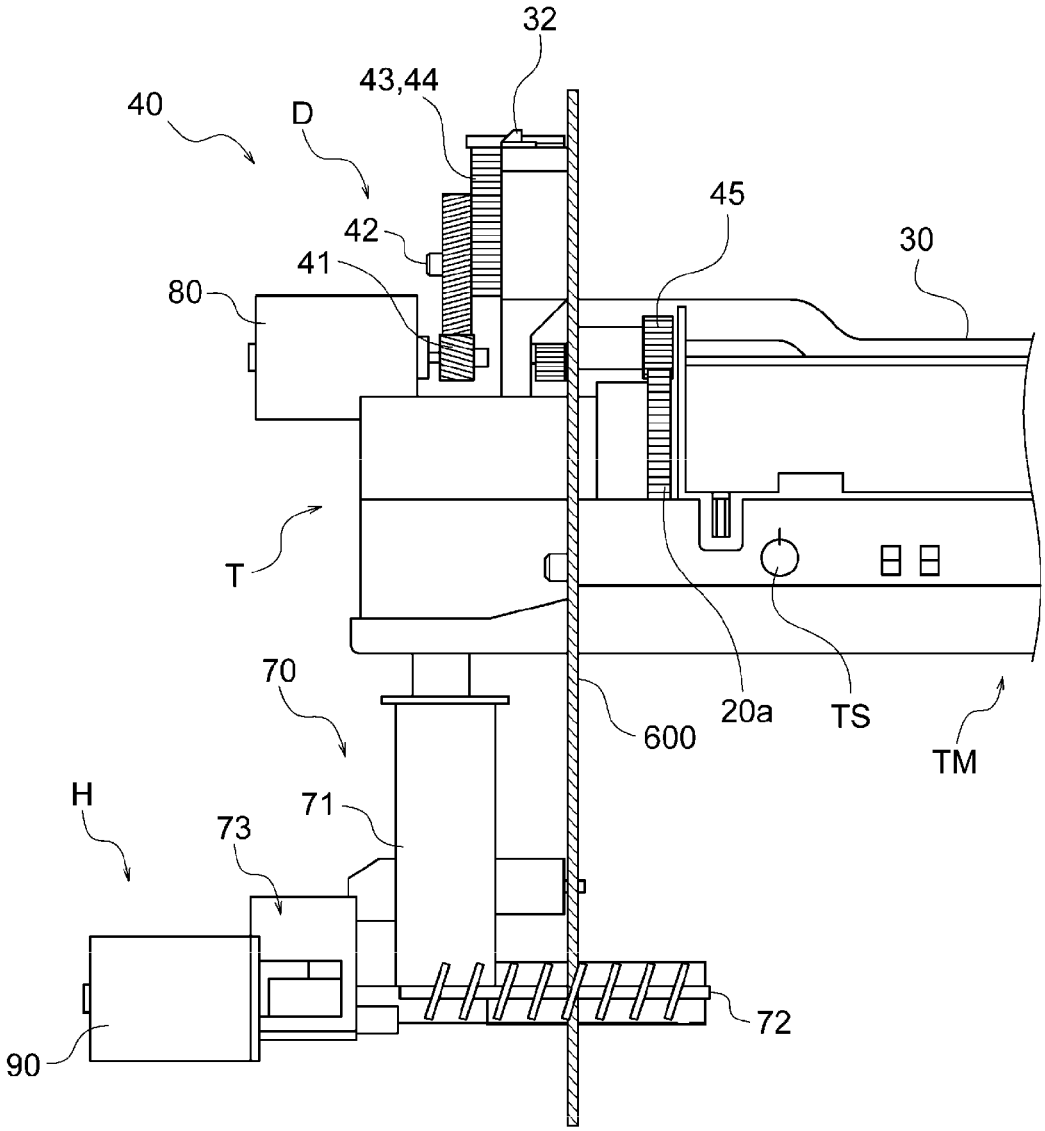
FIG. 6 is a side view of a replenishing driving device.

Next, a replenishing configuration for discharging toner from the toner storage container T will be described by using FIGS. 4 to 6. As described above, FIG. 4 is a top view of the image forming apparatus. In addition, FIG. 5 is a rear view of the image forming apparatus. FIG. 6 is a side view of the image forming apparatus.

As illustrated in FIG. 4, the toner storage container T is detachably stored in the toner storage container holding member TM stretched by the front side plate 500 and the rear side plate 600 of the image forming apparatus 200. In addition, an insertion and extraction side of the toner storage container T is covered by a front door 700 (cover member).

As illustrated in FIGS. 4 and 5, a replenishing driving device D (Dab and Dcd) is installed on the rear side plate 600. Here, the replenishing driving device Dab drives the toner storage container Ta and the toner storage container Tb, and the replenishing driving device Dcb drives the toner storage container Tc and the toner storage container Td.

The replenishing driving device D includes a bottle drive motor 80 (80*ab* and 80*cd*) and a gear train 40 which decelerates and transmits drive. As illustrated in FIG. 6, a drive gear 45 is installed in a final stage of the gear train and drivingly connected to the drive input gear 20*a* on the toner storage container T.

In addition, in order to detect the extension and contraction of the pump portion 20*b* (see, FIGS. 2A and 2B) of the toner storage container T, a phase detection sensor TS (TSa, TSb, TSc, and TSd) is installed on each toner storage contain holding member TM.

AS above, the drive from the bottle drive motor 80 is transmitted to the toner storage container T to allow toner replenishing operation of the toner storage container T.

An output of the bottle drive motor 80 is determined from toner concentration on the recording material S and so on by a CPU 50 illustrated in FIG. 1. Further, the rotation period, the rotation time, and the rotation speed of the bottle drive motor 80 are also determined by the CPU 50. At this time, the CPU 50 determines a rotation stop position based on a value of the phase detection sensor TS so that the pump portion 20*b* of the toner storage container T can be started with the state of being contracted every toner replenishing (FIG. 2B). Note that a state of the image forming apparatus 200 is displayed on a display portion 60 in FIG. 1.

Accordingly, a predetermined amount of toner is stably sent from the toner storage container T into the toner replenishing device 70.

In the toner replenishing device 70, toner conveyed from the toner storage container T to a toner storing portion 71 (71*a*, 71*b*, 71*c*, and 71*d*) and stored in the toner storing portion 71 is supplied to the developing device 100. The toner in the toner storing portion 71 is replenished with by drive of a replenishing device conveying portion H. More specifically, the replenishing device conveying portion H (Ha, Hb, Hc, and Hd) has a conveyance motor 90 (90*a*, 90*b*, 90*c*, and 90*d*) and a gear train 73 (73*a*, 73*b*, 73*c*, and 73*d*) transmitting drive of the conveyance motor 90 to each portion of the toner replenishing device 70. As illustrated in FIG. 6, a screw 72 and so on connected to the gear train 73 is then driven by the conveyance motor 90, whereby the developing device 100 is replenished with the toner from the toner storing portion 71 (see, FIG. 1).

<Replenishing Driving Configuration>

Figure 7A:
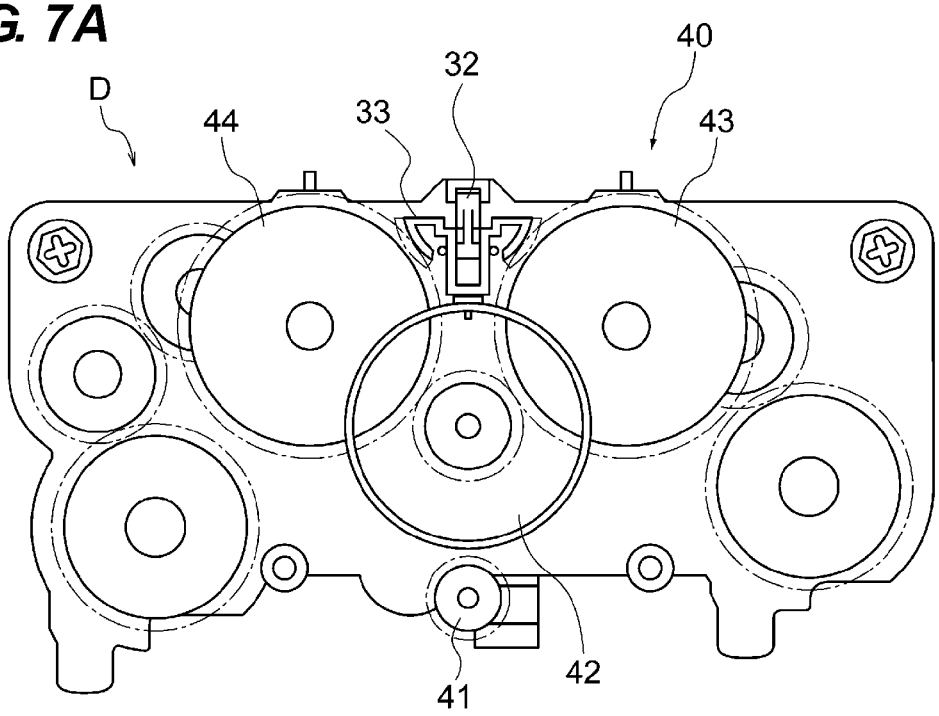
FIGS. 7A and 7B are explanatory views of a gear train of the replenishing driving device.
Figure 7B:
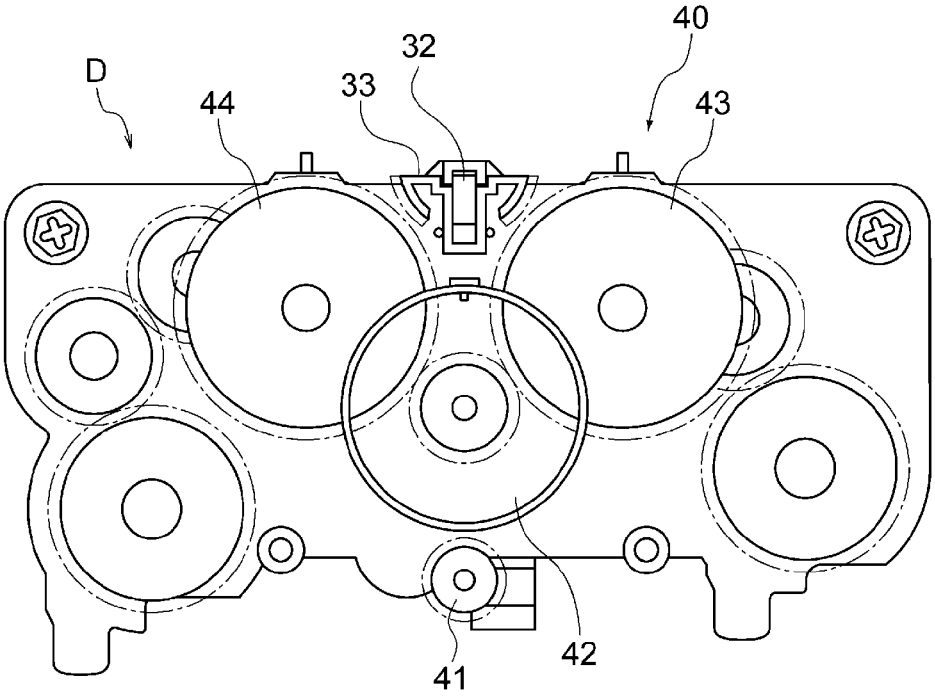
Figure 8:
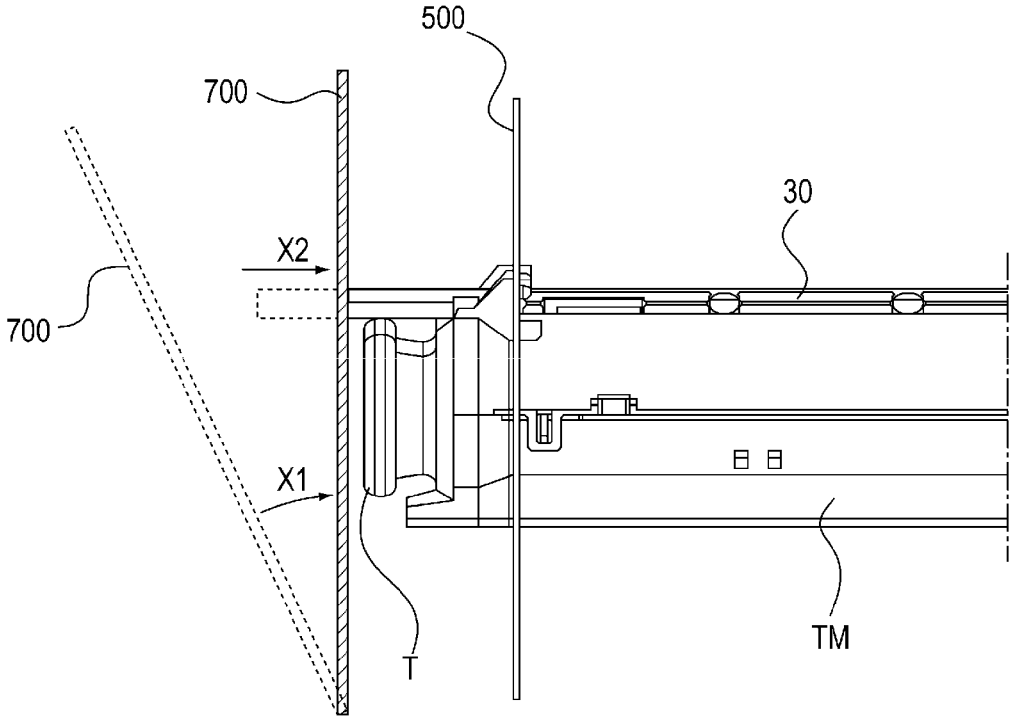
FIG. 8 is a view illustrating opening and closing operation of a front door.

A replenishing driving configuration having a characteristic configuration of the present embodiment will be described in detail by using FIGS. 6 to 8. As described above, FIG. 6 is a side view of the replenishing driving device. FIGS. 7A and 7B are explanatory views of the gear train of the replenishing driving device. FIG. 8 is a view illustrating opening and closing operation of the front door.

FIG. 7A illustrates the replenishing driving device D in which the front door 700 illustrated in FIG. 8 is in an opened state (dashed line position in FIG. 8), and FIG. 7B illustrates the replenishing driving device D in which the front door 700 illustrated in FIG. 8 is in a closed state (solid line position in FIG. 8).

When the front door 700 is closed, the front door 700 rotates in an X1 direction in FIG. 8. At this time, the front door 700 pushes an end of an opening/closing lever 30 (30*ab* and 30*cd*). Thus, the opening/closing lever 30 moves in an X2 direction in conjunction with closing operation of the front door 700. Consequently, the state illustrated in FIG. 7B is attained by the procedure as described later.

As illustrated in FIG. 6, the replenishing driving device D is installed in such a state that a pinion gear 41 (drive gear) attached coaxially with the bottle drive motor 80 meshes with a swing gear 42.

The bottle drive motor 80 can then rotate in forward and backward directions, and the swing gear 42 meshing with the pinion gear 41 is configured to selectively drive one of the toner storage containers T.

When the bottle drive motor 80 rotates in one direction (for example, the clockwise direction in FIGS. 7A and 7B), the swing gear 42 swings in the right direction in FIGS. 7A and 7B and meshes with a stage gear 43 (drive transmission gear). On the other hand, when the bottle drive motor 80 rotates in the other direction (for example, the counterclockwise direction in FIGS. 7A and 7B), the swing gear 42 swings in the left direction in FIGS. 7A and 7B and meshes with a stage gear 44 (drive transmission gear). When the swing gear 42 meshes with the stage gear 43, drive is not transmitted toward the stage gear 44 side, and when the swing gear 42 meshes with the stage gear 44, drive is not transmitted toward the stage gear 43 side.

While predetermined deceleration is performed downstream of the stage gear 43 and the stage gear 44, drive is connected to the drive input gear 20*a* on the toner storage container T. Namely, when the pinion gear 41 attached to the bottle drive motor 80 rotates in the clockwise direction in FIGS. 7A and 7B, the toner storage container Ta and the toner storage container Tc can be operated. Meanwhile, when the pinion gear 41 rotates in the counterclockwise direction, the toner storage container Tb and the toner storage container Td can be operated.

When the front door 700 becomes in the opened state, a user can touch the toner storage container T. In this case, as illustrated in FIG. 7A, a locking member 33 (rotation suppressing member) as a rotation regulating member meshes with the stage gear 43 and the stage gear 44. The locking member 33 thus meshes with the stage gear 43 and the stage gear 44 provided upstream of the drive input gear 20*a* and thereby reliably suppresses drive of the toner storage container T.

As described above, in the present embodiment, since there is a locking mechanism having the locking member 33, the toner storage container T can be prevented from being driven accidentally. In the present embodiment, as described later, in the locking mechanism the locking member 33 can move between a regulating position where rotation of the gear train 40 is regulated and a release position where the regulation of the rotation of the gear train 40 is released, whereby rotation of the toner storage container T is controlled.

Figure 9A:
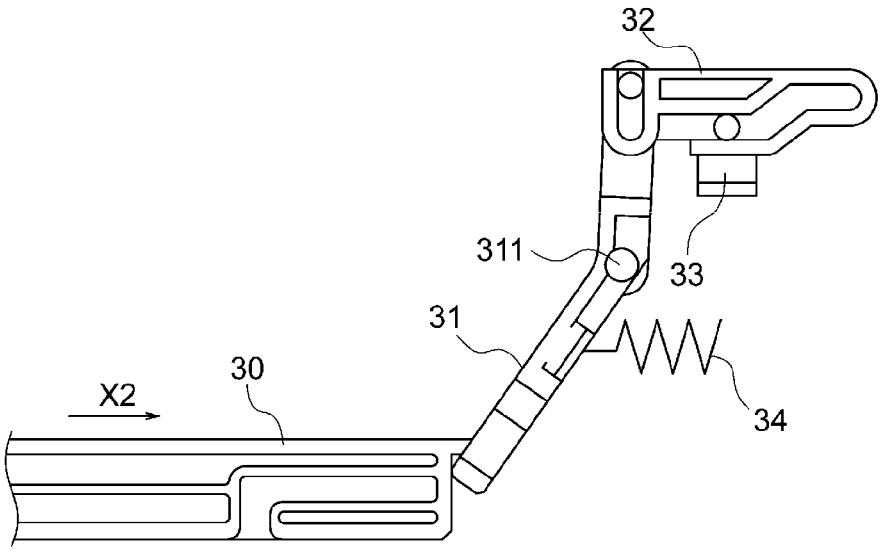
FIGS. 9A and 9B are explanatory views of operation of a locking mechanism.
Figure 9B:
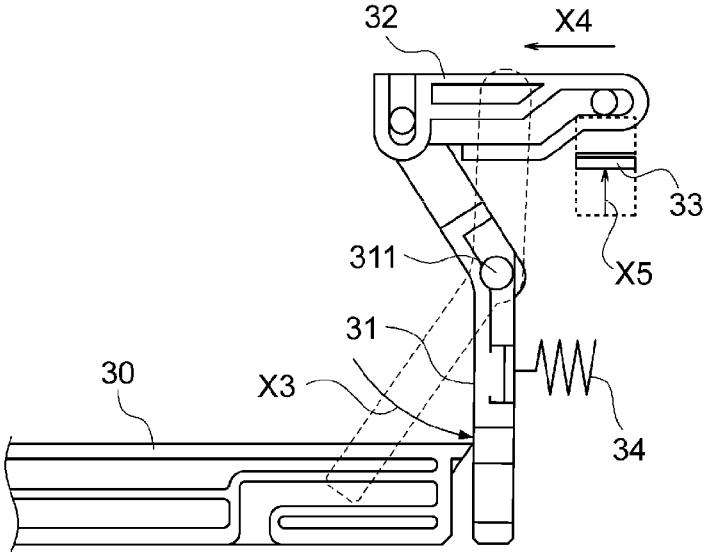

Here, the operation of the locking member 33 will be described. FIGS. 9A and 9B are explanatory views of operation of the locking mechanism. FIGS. 7A and 9A and FIGS. 7B and 9B correspond to the operation of the locking member 33.

As illustrated in FIGS. 9A and 9B, a link arm 31 rotates in an X3 direction around a rotation center 311, in association with movement of the opening/closing lever 30. At this time, the link arm 31 is biased in a direction opposite to the X2 direction by a locking spring 34.

When the link arm 31 rotates, a slider 32 moves in an X4 direction, and the locking member 33 moves in an X5 direction (see, FIGS. 9B and 7B).

Namely, when the state illustrated in FIG. 9A is attained in association with opening operation of the front door 700, the locking member 33 mates to the stage gear 43 and the stage gear 44 as illustrated in FIG. 7A. Since the stage gear 43 and the stage gear 44 are then locked, the rotation of the plurality of toner storage containers T is suppressed simultaneously.

Meanwhile, when the opening/closing lever 30 is forcibly pushed in the X2 direction (see, FIG. 9A), in association with the closing operation of the front door 700, the state illustrated in FIG. 9B is attained. The locking member 33 then moves in the X5 direction illustrated in FIG. 7B and becomes spaced apart from the stage gear 43 and the stage gear 44. Accordingly, the suppression of the rotation of the toner storage container T is released. Namely, locking is released.

As described above, the gear train 40 is connected from the stage gear 43 and the stage gear 44 to the drive input gear 20*a* (see, FIG. 6) of the toner storage container T. Thus, for example, even if a rotating force carelessly works on the toner storage container T during exchanging operation of the toner storage container T, the stage gear 43 and the stage gear 44 are fixed by the locking member 33, and therefore, it is difficult to rotate the toner storage container T.

When the force that rotates the toner storage container T in a normal rotating direction (toner dischargeable direction: regular rotation) works on the toner storage container T, the stage gear 43 is to rotate in the clockwise direction in FIGS. 7A and 7B, and the stage gear 44 is to rotate in the counterclockwise direction in FIGS. 7A and 7B. Thus, such a relation is formed that a force in a freely escape direction acts on the locking member 33. Accordingly, the locking member 33 regulates the rotation of the stage gears as explained above when a force is applied that rotates the stage gears in the normal rotation direction.

On the other hand, when the force that rotates the toner storage container T in a non-normal rotating direction (toner undischargeable direction: inverse rotation) works on the toner storage container T, the stage gear 43 facing the locking member 33 is to rotate in the counterclockwise direction in FIGS. 7A and 7B, and the stage gear 44 is to rotate in the clockwise direction in FIGS. 7A and 7B. Thus, such a relation is formed that a force in a freely bite direction acts on the locking member 33. Accordingly, the locking member 33 suppresses rotation of the stage gears when a force is applied that rotates the stage gears in the direction opposite to the normal rotation direction.

When the stage gear 43 rotates, the locking member 33 is biased in the direction of the stage gear 44, and when the stage gear 44 rotates, the locking member 33 is biased in the direction of the stage gear 43. Thus, a rotation suppressing force becomes higher than that in the above-described normal rotating direction of the toner storage container T. This can prevent the replenishing performance from being lowered when a user carelessly rotates the toner storage container T in the non-normal rotating direction.

Namely, when the toner storage container T is rotated in the non-normal rotating direction, toner is conveyed in a direction in which the toner is separated from the discharge port by a conveying blade provided in a bottle, resulting in such a state that the toner replenishing is less easily performed, and thus it may be erroneously detected that there is no toner. According to the configuration of the present embodiment, such problems as erroneous detection can be suppressed.

In addition, the locking member 33 suppresses rotation of gears upstream of the gear train 40. Thus, for example, even if the toner storage container T is carelessly rotated, a rotary torque can be reduced by a reduction ratio. Accordingly, the rotation of the toner storage container T can be suppressed with a relatively small load.

According to the configuration of the present embodiment, the reduction ratio from the stage gear 43 and the stage gear 44 to the drive input gear 20*a* of the toner storage container T is set to 5:1. Namely, a load of a locking spring can be reduced, and the operation force of the front door 700 can in turn be reduced.

Figure 10:
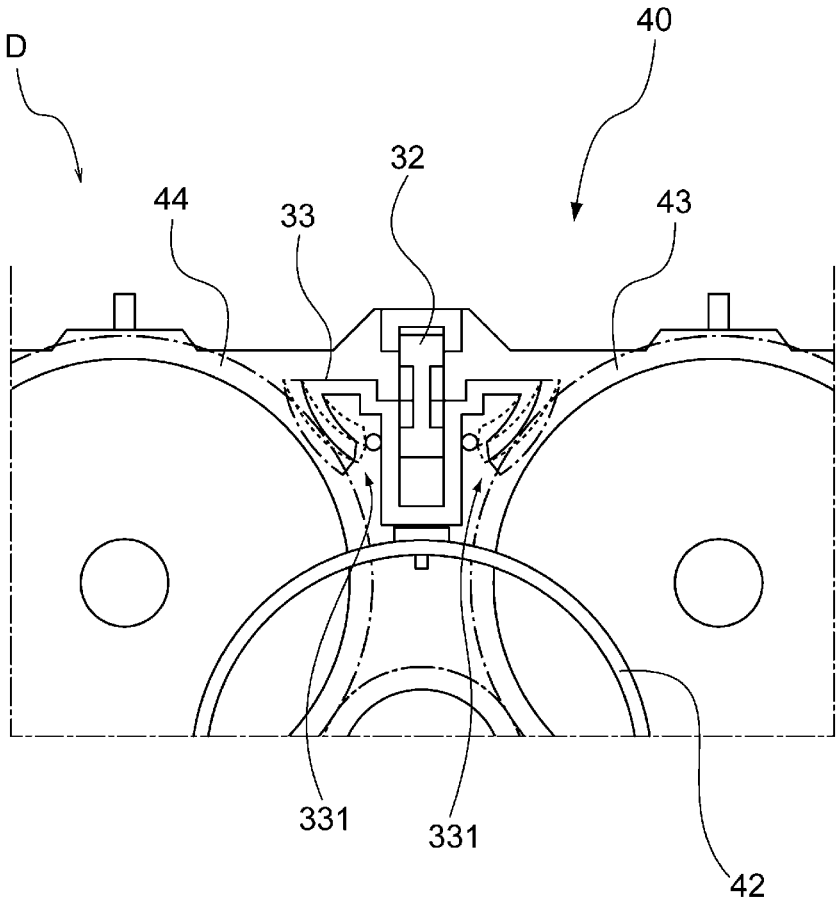
FIG. 10 is an explanatory view of flexibility of the locking mechanism.

FIG. 10 is an explanatory view showing how the locking member 33 is configured. If an excessive load is applied to either one of the stage gear 43 or the stage gear 44, this could damage the image forming apparatus. To prevent damage being caused by the locking member 33, at least a portion of the locking member comprises a flexible material. As illustrated in FIG. 10, a locking portion 331 of the locking member 33 has a space where the locking member 33 can be moved to by being bent due to its flexibility. Thus, the flexibility of the locking member 33 prevents the locking member 33 from applying an excessive load to either one of the stage gear 43 and the stage gear 44.

Furthermore, when a torque not less than a predetermined value is applied to the toner storage container T by a user, gear skip (deformation of the locking member 33 from an arrangement shown by the solid line in FIG. 10 to an arrangement shown by the dashed line in FIG. 10) occurs, whereby abnormal noise is generated, so that abnormal operation can be notified to the user.

The above configuration can suppress the rotation of the toner storage container T due to the careless operation of a user. Consequently, it is possible to suppress occurrence of apparatus failure and image defects caused by inflow of toner by preventing the inflow of toner from the toner storage container T into the developing container 101. Further, it is possible to suppress reduction in replenishing accuracy every replenishing due to change of a rotation start position of the toner storage container T.

As described above, the rotation of the toner storage container due to erroneous operation of a user can be suppressed. In addition, when a high load is applied to the toner storage container and even slight rotational operation is performed by a user, the abnormal noise is generated to notify the erroneous operation. Consequently, the occurrence of image defects due to inflow of toner is suppressed, and, at the same time, the reduction in the replenishing accuracy due to phase variation in carrying out the phase control can be suppressed.

Although in the present embodiment the locking member 33 is disposed upstream of a drive train, the present embodiment is not limited thereto. For example, the locking member 33 can be meshed with the drive input gear 20*a* of the toner storage container T, and the rotation of the toner storage container T can be suppressed. In this case, as described above, since a load torque from a user is applied directly to the locking member 33, it is necessary to make a configuration by further increasing a biasing force of the locking spring 34.

Further, although in the present embodiment the locking member 33 of the locking mechanism suppresses the drive of the plurality of stage gears 43 and the plurality of stage gears 44, the present embodiment is not limited thereto, and a configuration of suppressing drive of a single gear may be adopted.

Furthermore, although in the present embodiment a pump type toner storage container has been described as an example, the present embodiment is not limited to this configuration. Any toner storage container can be appropriately used as long as it has a gear which rotates the toner storage container.

The present invention can be utilized in an image forming apparatus (such as a printer, a copying machine, FAX, and a printer) having a toner storage container using an electrophotographic system.

According to the above configuration, accidental inflow of toner into a development device can be prevented, and occurrence of image defects caused by the accidental inflow of toner can be suppressed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2013-140343, filed Jul. 4, 2013, which is hereby incorporated by reference herein in its entirety.

What is claimed is:

1. A toner supply system including a toner receiving apparatus and a toner supply container detachably mountable to said toner receiving apparatus, said system comprising:

said toner supply container includes:

(i) a container body configured to contain toner;

(ii) a discharge port configured to permit discharging of the toner in said container body; and (iii) a feeding portion configured to feed the toner in said container body toward said discharge port with a rotation of said container body, said toner receiving apparatus includes:

(i) a toner receiving portion configured to receive the toner from said toner supply container, which is in a set position, through said discharge port;

(ii) a driving mechanism engageable with said container body to rotationally drive said container body; and (iii) a regulating mechanism movable between a regulating position, where the rotation of said container body, which is in the set position and is engaged with said driving mechanism, is regulated, and a releasing position, where regulation of rotation of said container body, which is in the set position and is engaged with said driving mechanism, is released.

2. The toner supply system according to claim 1, wherein said driving mechanism comprises a gear train engageable to said toner supply container, and wherein said regulating mechanism is configured to regulate rotation of a gear provided in said gear train when said regulating mechanism is in the regulating position.

3. The toner supply system according to claim 2, wherein said driving mechanism includes a reducing gear for reducing a rotational speed of said driving mechanism and an upstream gear which is located upstream of said reducing gear with respect to the direction of transmitting the drive in said gear train, and said regulating mechanism is movable between the regulating position where said regulating mechanism regulates rotation of said upstream gear and the releasing position where said regulating mechanism releases said regulation of rotation of said upstream gear.

4. The toner supply system according to claim 1, further comprising;

a mounting portion for mounting said toner supply container; and a door member for opening and closing said mounting portion, wherein said regulating mechanism is movable in association with movement of said door member;

when said door member is open, said regulating mechanism is positioned in the regulating position, and when said door member is closed, said regulating mechanism is positioned in the releasing position.

5. The toner supply system according to claim 2, wherein at least a portion of said regulating mechanism is flexible, and said portion meshes with said gear in said gear train.

6. The toner supply system according to claim 1, further comprising a shutter provided on said toner supply container for opening and closing said discharge port, wherein said shutter is configured to be opened in association with a sliding operation of said toner supply container to the set position by sliding in a direction along a rotary axis of said toner supply container.

7. The toner supply system according to claim 6, wherein said shutter is configured to be closed in association with a sliding operation of said toner container from the set position by sliding in a direction along a rotary axis of said toner supply container.

8. A toner supply system including a toner receiving apparatus, a first toner supply container, and second toner supply container detachably mountable to said toner receiving apparatus respectively, said system comprising:

said first toner supply container includes:

(i) a first container body configured to contain toner;

(ii) a first discharge port configured to permit discharging of the toner in said first container body; and (iii) a first feeding portion configured to feed the toner in said first container body toward said first discharge port with rotation of said first container body, said second toner supply container includes:

(i) a second container body configured to contain toner;

(ii) a second discharge port configured to permit discharging of the toner in said second container body; and (iii) a second feeding portion configured to feed the toner in said second container body toward said second discharge port with rotation of said second container body, said toner receiving apparatus includes:

(i) a first toner receiving portion configured to receive the toner from said first toner supply container, which is in a first set position, through said first discharge port;

(ii) a second toner receiving portion configured to receive the toner from said second toner supply container, which is in a second set position, through said second discharge port;

(iii) a driving mechanism engageable with said first and second container bodies to rotationally drive said first and second container bodies; and (iv) a common regulating member movable between a regulating position, where the rotation of said first container body, which is in the first set position, and the rotation of said second container body, which is in the second set position, and are engaged with said driving mechanism, is regulated, and a releasing position where regulating of rotation of said first container body, which is in the first set position, and rotation of said second container body, which is in the second set position, and which are engaged with said driving mechanism, is released.

9. The toner supply system according to claim 8, further comprising, a common motor configured to drive said first toner supply container and said second toner supply container, wherein said driving mechanism includes a first gear for transmitting a drive to said first toner supply container when said motor is rotated in the first direction and a second gear for transmitting a drive to said second toner supply container when said motor is rotated in the second direction, and said regulating member regulates rotation of said first and second toner container bodies by engaging with both said first gear and said second gear.

10. A toner supply system including a toner receiving apparatus and a toner supply container detachably mountable to said toner receiving apparatus, said system comprising:

said toner supply container includes:

(i) a container body configured to contain toner;

(ii) a discharge port configured to permit discharging of the toner in said container body;

(iii) a shutter provided on said toner supply container for opening and closing said discharge port, said shutter being configured to be opened in association with movement of said toner supply container to a set position; and (iv) a feeding portion configured to feed the toner in said container body toward said discharge port with rotation of said container body, said toner receiving apparatus includes:

(i) a toner receiving portion configured to receive the toner from said toner supply container, which is in the set position, through said discharge port;

(ii) a mounting portion for mounting said toner supply container;

(iii) a door member for opening and closing said mounting portion;

(iv) a driving mechanism engageable with said container body to rotationally drive said container body; and (v) a regulating mechanism movable between a regulating position, where said rotation of said container body, which is in the set position and is engaged with said driving mechanism, is regulated, and a releasing position where regulation of rotation of said container body, which is in the set position and is engaged with said driving mechanism, is released in association with movement of the door member:

wherein when said door member is open, said regulating mechanism is positioned in the regulating position; and when said door member is closed, said regulating mechanism is positioned in the releasing position.

11. A toner supply system including a toner receiving apparatus, a first toner supply container, and a second toner supply container detachably mountable to said toner receiving apparatus respectively, said system comprising:

said first toner supply container includes:

(i) a first container body configured to contain toner;

(ii) a first discharge port configured to permit discharging of the toner in said first container body;

(iii) a first feeding portion configured to feed the toner in said first container body toward said first discharge port with rotation of said first container body; and (iv) a first shutter provided on said first toner supply container for opening and closing said first discharge port, said first shutter being configured to be opened in association with a movement of said first toner supply container to a first set position;

said second toner supply container includes:

(i) a second container body configured to contain toner;

(ii) a second discharge port configured to permit discharging of the toner in said second container body;

(iii) a second feeding portion configured to feed the toner in said second container body toward said second discharge port with rotation of said second container body; and (iv) a second shutter provided on said second toner supply container for opening and closing said second discharge port, said second shutter being configured to be opened in association with a movement of said second toner supply container to a second set position;

said toner receiving apparatus includes:

(i) a first toner receiving portion configured to receive the toner from said first toner supply container, which is in the first set position, through said first discharge port;

(ii) a second toner receiving portion configured to receive the toner from said second toner supply container, which is in the second set position, through said second discharge port;

(iii) a first mounting portion for mounting said first toner supply container;

(iv) a second mounting portion for mounting said second toner supply container;

(v) a door member for opening and closing said first and second mounting portions;

(iv) a driving mechanism engageable with said container body to rotationally drive said container body; and (v) a common regulating member movable between a regulating position, where rotation of said first container body, which is in the first set position, and rotation of said second container body, which is in the second set position, and are engaged with said driving mechanism, is regulated, and a releasing position where regulating of rotation of said first container body, which is in the first set position, and rotation of said second container body, which is in the second set position, and are engaged with said driving mechanism, is released in association with movement of said door member, wherein when said door member is open, said regulating member is positioned in the regulating position, and when said door member is closed, the regulating member is positioned in the releasing position.

* * * * *